US006837757B2

(12) United States Patent
Van Dine et al.

(10) Patent No.: US 6,837,757 B2
(45) Date of Patent: Jan. 4, 2005

(54) RIM-DRIVEN PROPULSION POD ARRANGEMENT

(75) Inventors: Pieter Van Dine, Mystic, CT (US); Alberto Franco, Hazlet, NJ (US); R. Scott Forney, III, Stonington, CT (US); John H. Chapman, Noank, CT (US); Michael A. Quadrini, Westerly, RI (US)

(73) Assignee: Electric Boat Corporation, Groton, CT (US)

( * ) Notice: Subject to any disclaimer, the term of this patent is extended or adjusted under 35 U.S.C. 154(b) by 0 days.

(21) Appl. No.: 10/123,374

(22) Filed: Apr. 16, 2002

(65) Prior Publication Data

US 2003/0194922 A1 Oct. 16, 2003

(51) Int. Cl.[7] ..... B60L 11/00
(52) U.S. Cl. ..... 440/6; 310/87
(58) Field of Search ..... 440/6, 38, 80, 440/81; 310/87, 89, 90, 114

(56) References Cited

U.S. PATENT DOCUMENTS

| | | | | | |
|---|---|---|---|---|---|
| 2,714,866 | A | * | 8/1955 | Pleuger et al. | 440/6 |
| 3,143,972 | A | | 8/1964 | Smith et al. | 440/6 |
| 3,707,939 | A | * | 1/1973 | Berg | 440/58 |
| 3,708,251 | A | * | 1/1973 | Pierro | 440/6 |
| 4,831,297 | A | | 5/1989 | Taylor et al. | 310/87 |
| 4,930,201 | A | | 6/1990 | Brown | 29/598 |
| 5,078,628 | A | | 1/1992 | Garis, Jr. | 440/6 |
| 5,101,128 | A | | 3/1992 | Veronesi et al. | 310/54 |
| 5,185,545 | A | | 2/1993 | Veronesi et al. | 310/114 |
| 5,205,653 | A | | 4/1993 | Veronesi et al. | 384/306 |
| 5,220,231 | A | | 6/1993 | Veronesi et al. | 310/90 |
| 5,252,875 | A | | 10/1993 | Veronesi et al. | 310/114 |
| 5,289,068 | A | | 2/1994 | Veronesi et al. | 310/114 |
| 5,408,155 | A | | 4/1995 | Dickinson et al. | 310/90 |
| 5,490,768 | A | | 2/1996 | Veronesi et al. | 417/356 |
| 5,522,335 | A | | 6/1996 | Veronesi et al. | 114/151 |
| 5,702,273 | A | | 12/1997 | Cho et al. | 440/6 |
| 6,069,421 | A | | 5/2000 | Smith et al. | 310/43 |
| 6,130,494 | A | | 10/2000 | Schöb | 310/90.5 |
| 6,312,298 | B1 | * | 11/2001 | Schuring | 440/6 |

* cited by examiner

*Primary Examiner*—Lars A. Olson
(74) *Attorney, Agent, or Firm*—Howrey Simon Arnold & White, LLP; Michael J. Bell

(57) ABSTRACT

In the embodiments described in the specification, a rim-driven propulsion pod arrangement has a cylindrical housing with a duct providing a flow path for water and a rotor assembly supported from a central shaft and containing a rotating blade row and driven by a rim drive permanent magnet motor recessed in the housing. An array of vanes downstream from the rotating blade row is arranged to straighten the flow of water emerging from the rotating blade row. Radial bearing members on the rotor have a hardness less than that of the shaft on which the rotor is supported and relatively soft protrusions are provided in the space between the rotor and the housing to limit excursion of the rotor. A thrust bearing has wedges arranged to form a water wedge between facing surfaces of the rotor and the rotor support during rotation of the rotor.

17 Claims, 6 Drawing Sheets

RIM-DRIVEN PROPULSION POD ARRANGEMENT

BACKGROUND OF THE INVENTION

This invention relates to propulsion pods having rim-driven blade sets for propelling marine vessels.

Conventional propulsion pods with rim-driven blade sets for marine vessels are subject to vibrations produced by turbulence in the water passing through the pod which may be excessive and may be transmitted to a vessel being propelled and also may be subject to wear of the parts supporting the rotating blade sets.

The Veronesi et al. U.S. Pat. No. 5,252,875 discloses a propulsion pod containing a permanent magnet motor driving a rotating blade set and having a rotor rim surrounding the blade set embedded in the surrounding structure so that it is out of the flow path of water through the pod and providing circulation of water through the space between the rotor and the stator from the high pressure side of the rotor to the low pressure side. That arrangement also provides stationary vanes following the rotating blade set to minimize swirling of the water driven by the blade set and also minimize cavitation and enhance efficiency.

U.S. Pat. No. 5,408,155 to Dickinson discloses a propulsion pod containing a rotor having radial and thrust bearing assemblies with engaging hard surfaces on both rotating and stationary components.

The Veronesi et al. U.S. Pat. No. 5,205,653 discloses a propulsion pod containing a rotor and a circular array of pivoting support members in an adjacent stationary part having thrust bearing surfaces for engagement with an adjacent surface of the rotor.

SUMMARY OF THE INVENTION

Accordingly, it is an object of the present invention to provide a rim-driven propulsion pod arrangement which overcomes disadvantages of the of the prior art.

Another object of the invention is to provide a rim-driven propulsion pod arrangement which minimizes vibration and has improved efficiency.

These and other objects of the invention are attained by providing a rim-driven propulsion pod arrangement incorporating a permanent magnet motor with a motor rotor mounted on the rim of a propeller or rotating blade set and surrounded by a stator which is recessed in the surrounding pod portion, permitting the rotor rim to be disposed out of the path of the water passing through the pod. In the preferred embodiment the stator and rotor are canned in composite material to ensure eddy currents are not induced, avoiding efficiency losses. In a preferred embodiment, water is circulated through a path within the pod between adjacent rotor and stator surfaces for cooling and for flushing of any debris from the space between the stator and the rotor. In order to minimize turbulence resulting from return of the circulated water to the low pressure side of the rotating blade set, the return duct is shaped to direct the flow of water at an angle inclined toward the rotating blades rather than radially inward into the flow path. In addition, the propulsion pod includes a stationary blade set located adjacent to and downstream of the rotating blade set which is arranged to cancel swirl in the water ejected by the rotating blades. The design and arrangement of the stationary blade row and the rotating blade row is optimized for efficiency, to reduce cavitation and to minimize induced structural vibration.

In order to assure structural efficiency, ease of wire routing, and even motor cooling, the propulsion pod is preferably supported from a vessel to be propelled by a strut which is attached to the pod adjacent to the plane of the fixed blade set within the pod and spaced from the plane of the rotating blade set. In a preferred embodiment the strut, which carries power and instrumentation lines from the vessel to the pod, has a dry interior with seals between the strut and the pod.

To minimize vibration and wear the rotor is supported by a radial bearing system which provides radial support utilizing radial bearing wear surfaces which in all cases rotate with the rotor to even wear distribution and includes a thrust bearing system which transfers thrust to the stationary structure through thrust bearing surfaces which are machined pad shapes on a solid ring designed to enhance water wedge formation. In addition, soft stationary snubbers or button bearings are located in the pod housing adjacent to the rim of the rotor to limit excursion in the thrust and radial directions which might result from impact, sand or other unusual actions.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
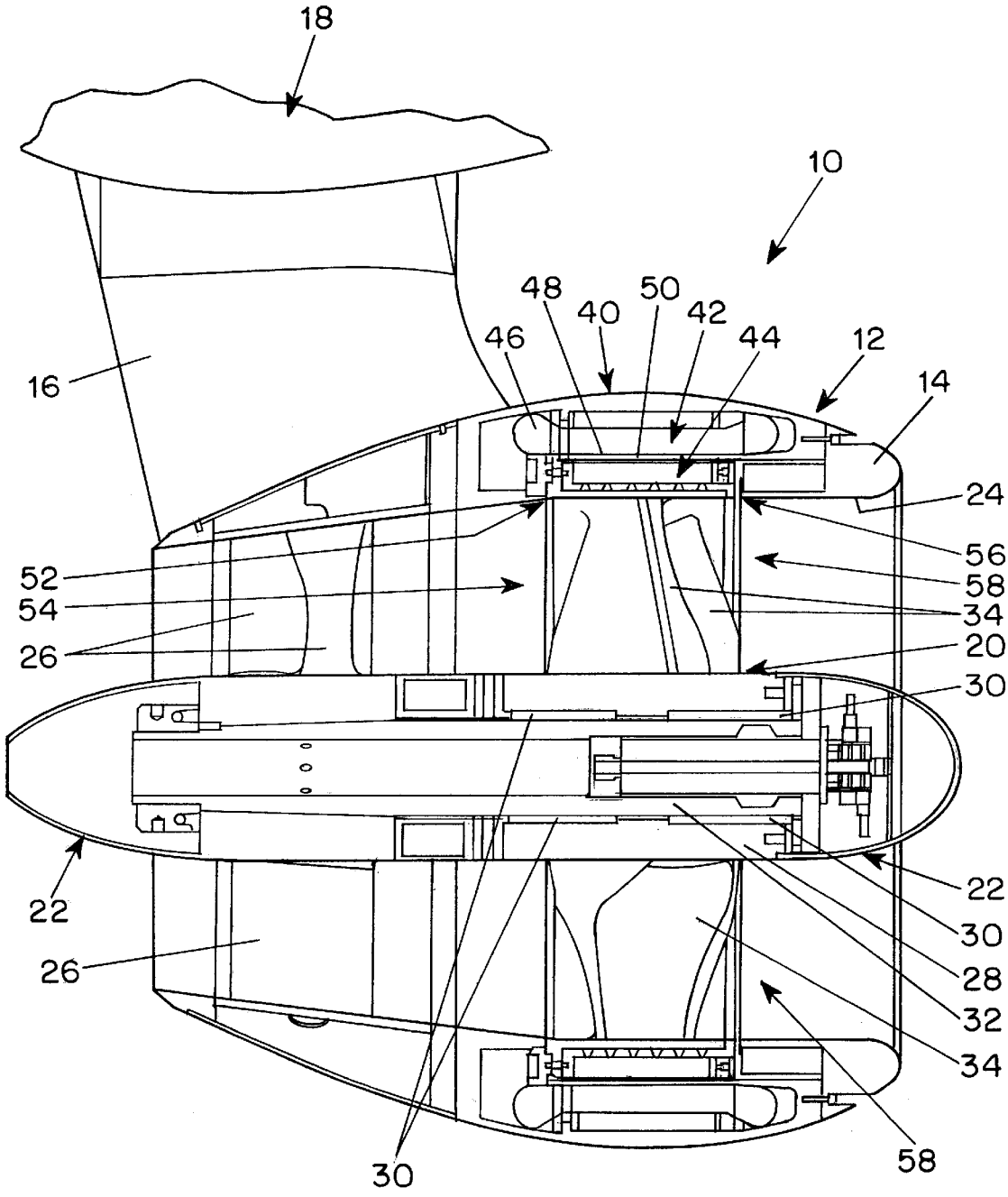
FIG. 1 is a schematic view in longitudinal section illustrating a representative embodiment of a rim-driven propulsion pod arrangement in accordance with the invention.

In the typical embodiment of a rim-driven propulsion pod arrangement 10 shown in FIG. 1, a pod 12 has a housing 14 supported by a strut 16 from an adjacent vessel 18 which is to be propelled by the propulsion unit. The pod 12 contains a rotor assembly 20 rotatably supported by a rotor support assembly 22 which is centrally mounted within a central duct 24 in the housing 14 by an array of support members 26 shaped in the form of vanes or blades to guide water emerging from the rotor assembly 20.

The rotor assembly 20 includes a hub 28 containing a plurality of radial bearings 30 rotatably supporting the hub on a central support shaft 32 of the support assembly and an angularly distributed array of blades 34 mounted on the hub and designed and shaped to propel water rearwardly through the housing in an efficient manner during rotation of the rotor assembly. The stationary blades 26 and the rotating blades 34 are designed as a set to cancel the swirl in the water driven by the rotating blades to eject water from the propulsion unit with maximum efficiency while minimizing cavitation and induced structural vibration by recovering pressure that is normally lost on the inside surface of the housing of a rim-driven propulsion unit.

The factors considered in the design of the fixed and rotating blades to be optimized as a matched set are efficiency, cavitation and hull-induced vibration as well as the length and diameter of the propulsion pod and its weight and structural integrity. A configuration in which the rotating blade row 34 is located upstream of the stationary blades 26 is preferred because of the necessity of positioning the motor at the location of maximum duct thickness, typically about the duct quarter chord which positions the rotating blades forward of the stationary blades to minimize the duct length and pod weight. Preferably, to help maximize efficiency, only two blade rows are used. The forward, rotating blade row 34 converts rotational energy or torque into thrust, resulting in swirling of the downstream flow which is a hydrodynamic loss manifested by reduced efficiency. To increase the efficiency the downstream, stationary blade row 26 is designed to remove the swirl which has been imparted by the rotating blade row resulting in a discharge of water from the pod which is essentially entirely in the axial direction.

For this purpose, the total blade surface area of each blade row 26 and 34 is chosen to provide the desired thrust and torque while maintaining acceptable cavitation performance and efficiency. For improved cavitation performance larger blade surface areas are desired while for improved efficiency smaller blade surface areas are designed. This disharmony is resolved by choosing a blade row surface area which achieves the desired cavitation performance but maximizes efficiency and this approach is used for both the rotating and stationary blade rows.

Given a total desired surface area for each blade row, the size of the individual blades is then determined and several factors are included in this determination. The diameter of the rotating blade row is chosen to be as large as possible to allow the rim drive motor to be as small as possible in length. The maximum diameter is constrained by two factors: the keel depth of the vessel being driven compared to the hull stern offsets and the proximity of the propulsion pod to the hull to achieve acceptable water-borne path hull unsteady pressures which induce hull vibration. It has been determined that a rim-driven pod arrangement will result in significantly lower hull unsteady pressures than those generated by an open propeller because the rim-driven pod housing shields the blades and because of the different type of cavitation produced.

The diameter of the stationary blade row 26 is chosen to be approximately equal to that of the rotating blade row 34 to maintain a smooth inner contour of the duct 24. Given that diameter, the required total blade row area is determined by selection of the blade number and the length of the blades in the axial direction of the duct or "chord length". High blade numbers are desired since that results in shorter chord lengths which allows for a shorter duct and therefore improved efficiency, and the maximum number of blades is dictated by structural integrity and the ability to physically attach the blades to the hub. The hub diameter is established to accommodate the bearings and the size of the shaft on which the hub is mounted, which results in a given circumference of the hub. That circumference determines the maximum number of blades which can be attached to the hub.

In addition, as the blade number increases, the blade chord length, and hence the blade thickness, decreases proportionately, resulting in a blade cross-sectional area that decreases directly with the blade number increase. Blade stresses are a factor in determining the blade number.

The separation between the blade rows is driven by maximizing efficiency while minimizing the interaction between blade rows and the duct length is fixed in part by the separation between the blade rows. To maximize efficiency a short duct, i.e., a minimum blade row separation is desired. However, blade rows which are too close together experience both various and potential interactions which lead to unacceptable hull vibration. Therefore, a minimum separation between blade rows is chosen that lead to acceptable levels of interaction. Preferably, the spacing between the blade rows is between about 25 and about 100% of the chord length, i.e., the axial length, of the blades in the first blade row and the number of blades in each blade row is from about five to about fifteen while the expanded area ratio, i.e., the percentage of the cross-sectional area of the duct covered by the blades if viewed in the axial direction, is between about 50% and 110%.

Many conventional radial bearing arrangements for rotating blade sets tend to preferentially wear away one side of the support shaft, eventually causing the rotor to be positioned off-center with respect to the surrounding housing. With a rim drive motor such eccentricity causes variations in the flux linkage of the stator windings with the permanent magnets in the rotor, interfering with the drive function of the motor. In order to avoid this problem in the rim drive arrangement of the present invention the central support shaft 32 has a surface made of a hard material such as steel, a nickel based alloy or a chrome, while the radial bearings 30 which engage that surface are made of a relatively softer material which may be a soft metal or a polymer or the like. This results in uniform wear of the bearings 30 and minimal wear of the support shaft 32 as the rotor rotates.

In order to drive the rotor assembly 20 a rim drive motor 40 includes a stator section 42 mounted within the housing 14 and a rotor section 44 affixed to and surrounding the outer ends of the blades 34 and containing a circumferential array of permanent magnets which interact with magnetic fields generated by windings 46 in the stator 42 to apply torque to the rotor assembly when the windings are energized. The stator and rotor are canned in composite resin material to avoid efficiency losses due to eddy currents that are induced in conductive metallic can materials.

To assure cleaning and cooling of the annular space 48 between the facing surfaces of the rotor 44 and the stator 42 in the rim drive motor 40, a flow passage 50 is provided for water from an inlet 52 at the high pressure region 54 in the water flow path through the duct 24 following the rotating blades 34 to an outlet 56 to the low pressure region 58 of the duct preceding the blades 34 where the water is directed back into the stream flowing through the duct.

Figure 2:
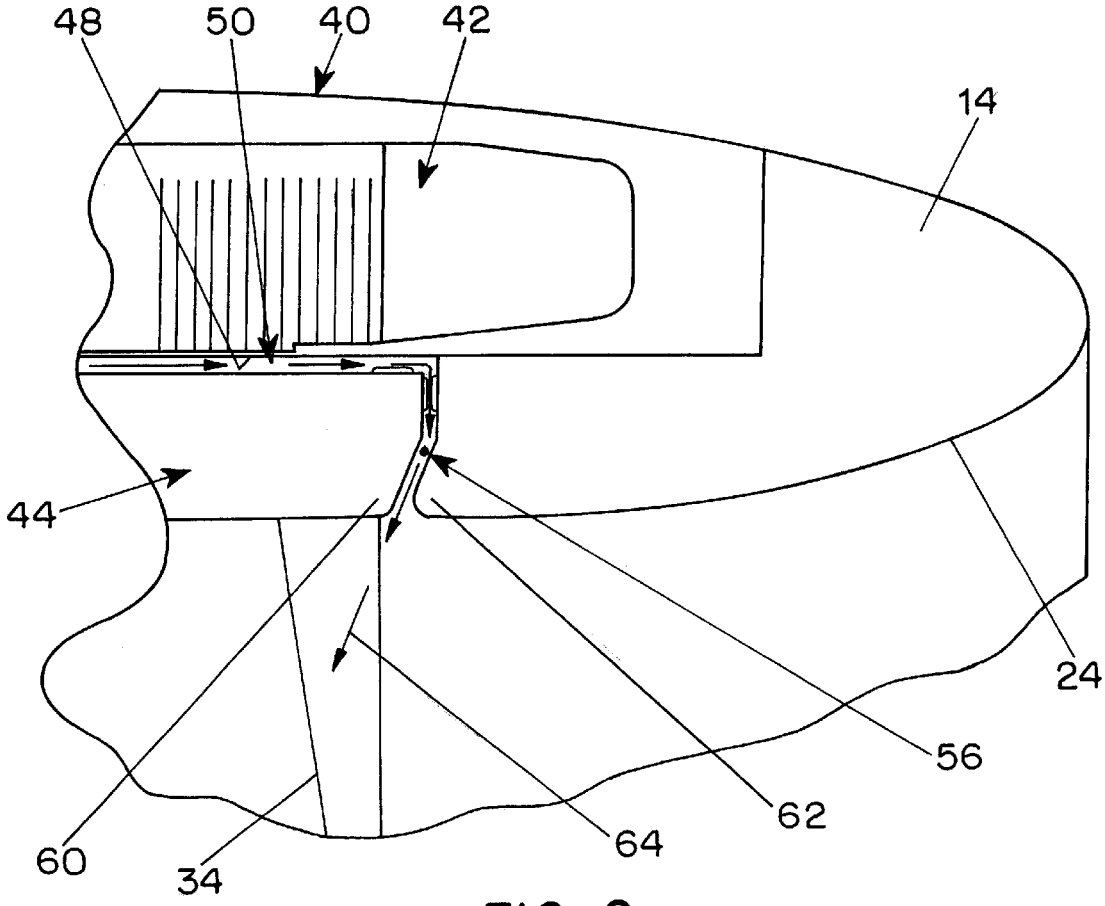
FIG. 2 is a fragmentary view illustrating a path for flow of cooling water between the rotor and the stator in the pod housing.

To avoid generating turbulence as the circulated water is ejected from the outlet 56 into the stream of water flowing through the duct 24, the leading end 60 of the rotor 44 is inclined in the rearward direction and a rearwardly projecting lip 62 is formed in the adjacent portion of the housing 14, as shown in FIG. 2, to guide the water rearwardly at an angle toward the rotating blades 34 in the manner indicated by the arrow 64 in FIG. 2. Preferably, the angle of the outlet 56 formed by the parts 60 and 62 is in a range from about 30° to about 60° from the direction of flow of the water through the duct, and an angle between about 30°and about 45° has been found to be most effective.

The leading edge of the rotating blades 34 is set as close as possible to the outlet 56 from the passage 52 to minimize the overall length of the rotor for greater efficiency. Increasing the distance between the outlet 56 from the passage 50 to the blades 34 will allow the reentry turbulence to dissipate, while increasing the surface area of the housing to which the water flowing through the duct, resulting in hydrodynamic losses.

Figure 3:
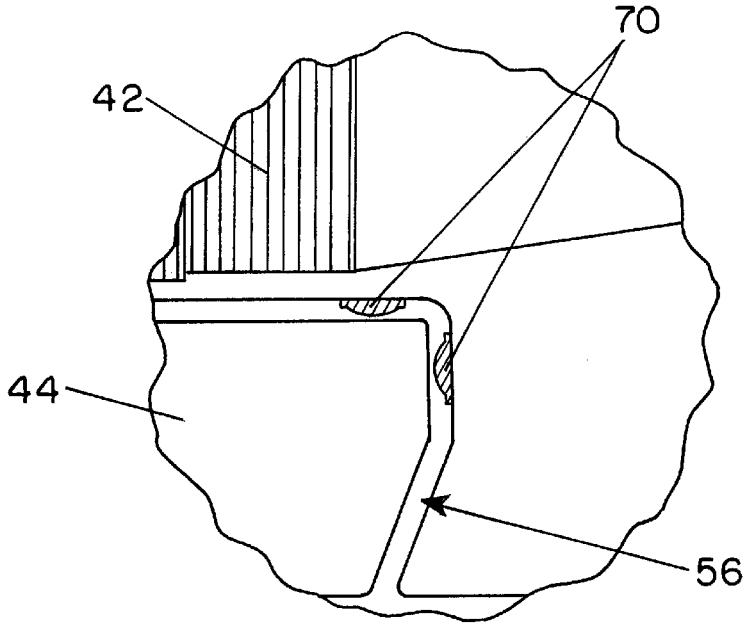
FIG. 3 is an enlarged fragmentary view illustrating button bearing snubbers in the pod housing for limiting excursions of the rotor.
Figure 4:
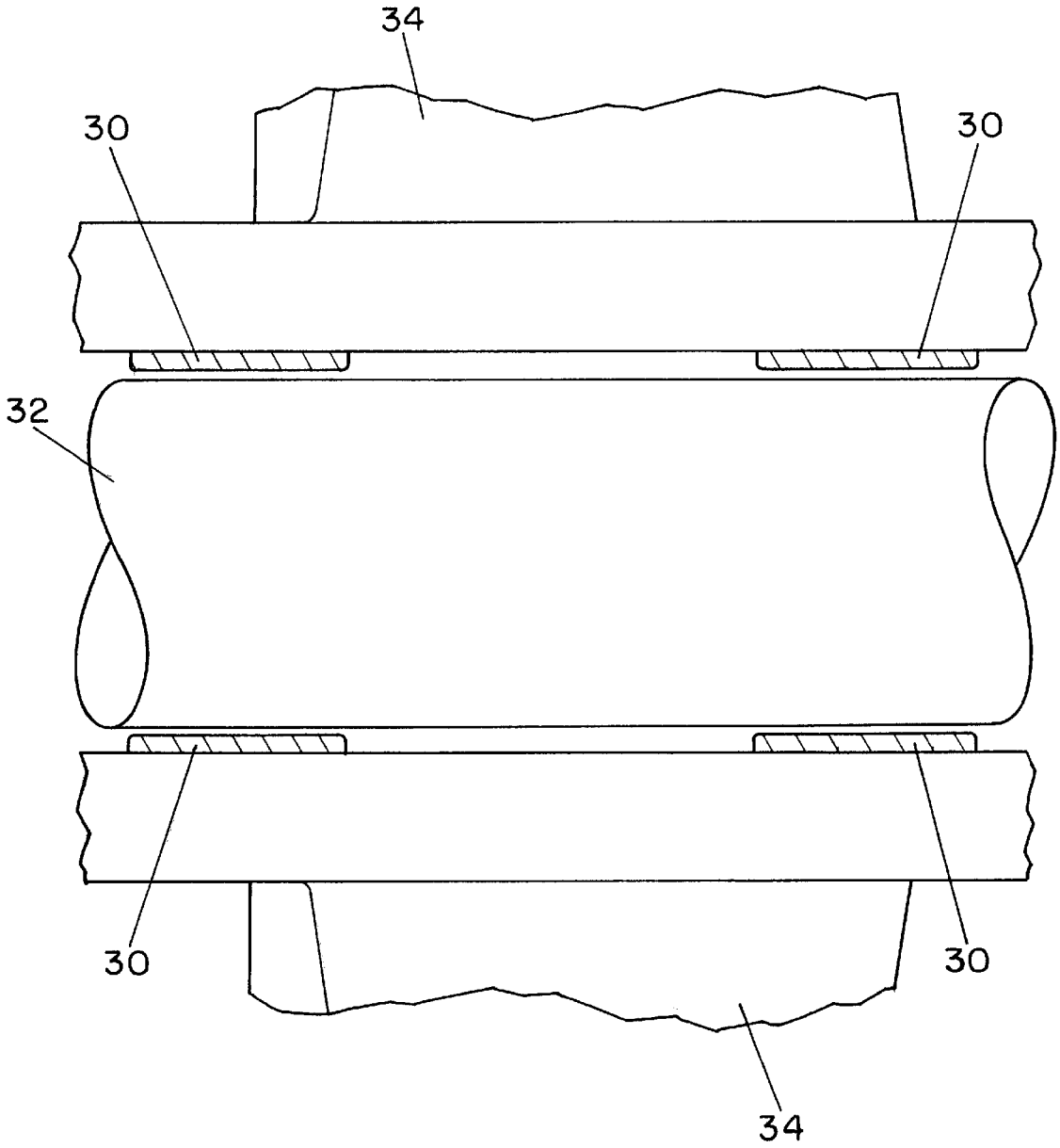
FIG. 4 is an enlarged fragmentary view illustrating bearings on the rotor for radial support of the rotor from a stationary shaft.

In order to limit excursions of the rotor assembly 22 with respect to the housing 14, which might result from a collision or impact on the pod, the surfaces of the housing 14 in the passage 50 are formed with small protrusions such as snubbers or button bearings 70 within the space between the rotor 44 and the stator 42 as shown in the magnified fragmentary view of FIG. 3. The protrusions 70 are preferably made of soft material such as a polymer and are effective to prevent hard contact between the adjacent rotating and stationary surfaces in the event of impact, thereby assuring that the propulsion unit is not damaged and continues to operate.

Figure 7:
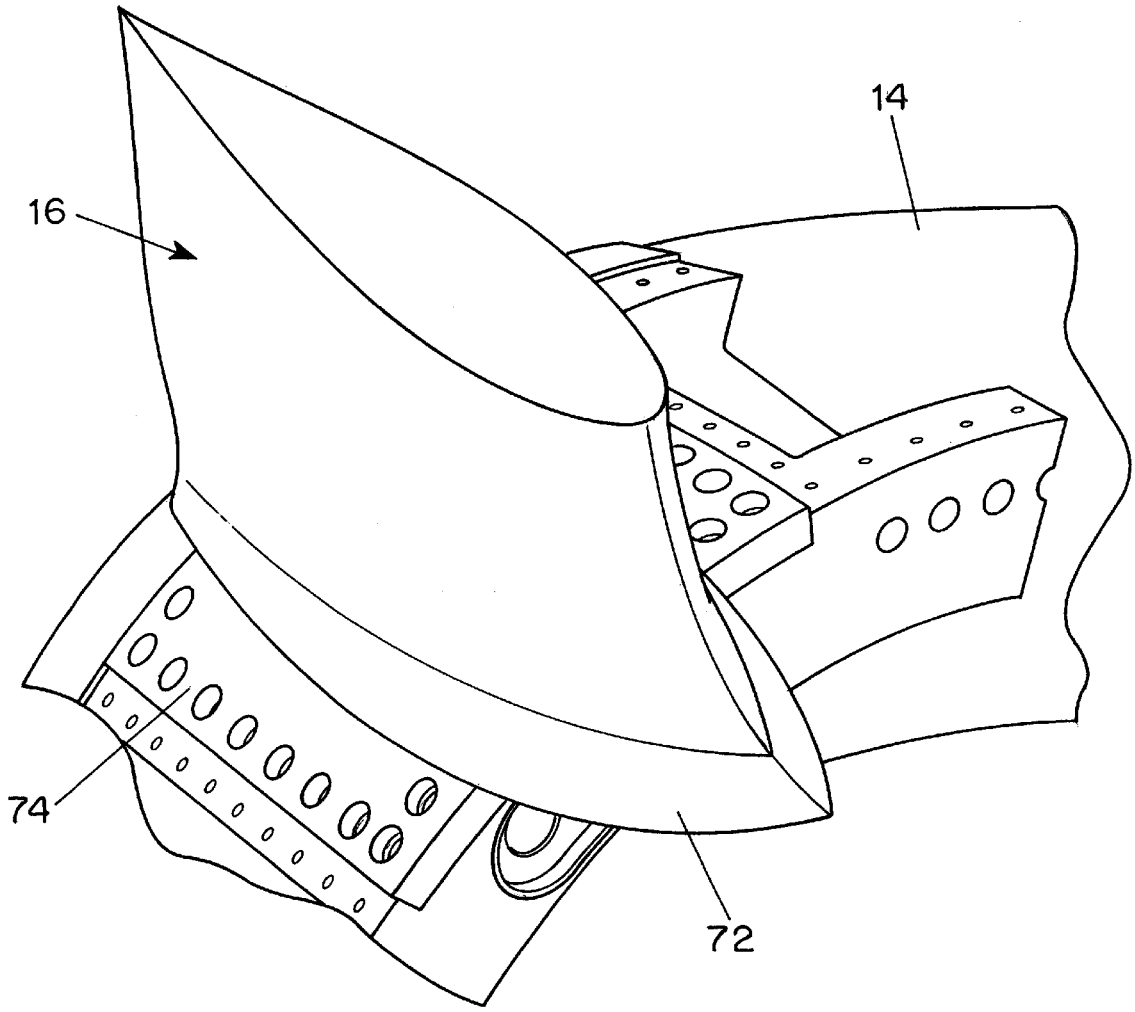
FIG. 7 is a fragmentary perspective view illustrating the arrangement for a strut for mounting the pod to a vessel to be propelled by the pod.
Figure 8:
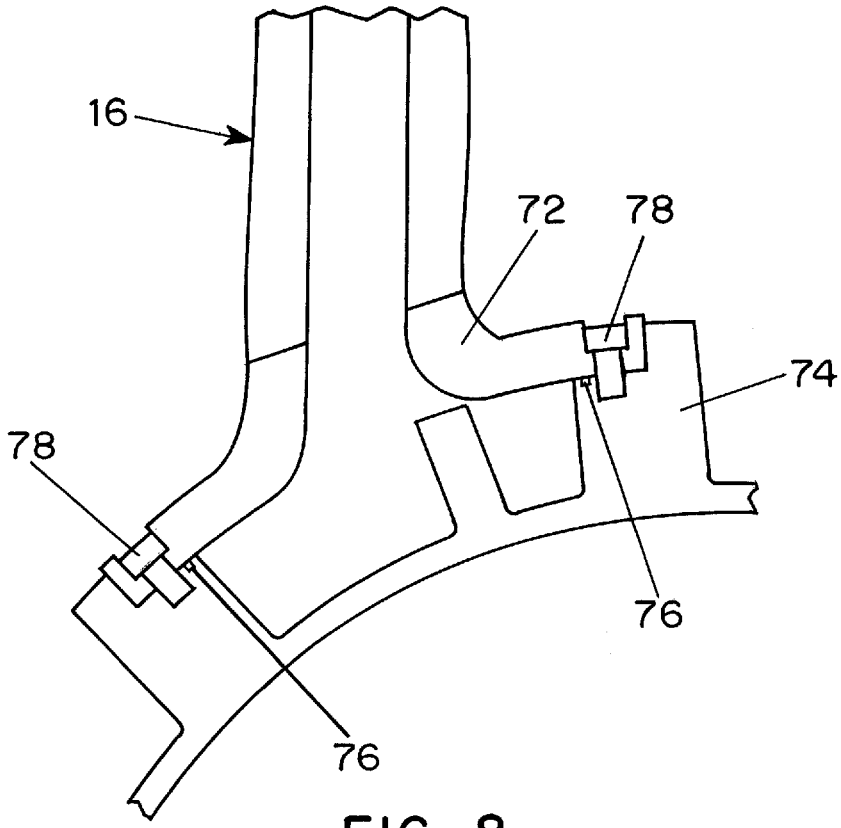
FIG. 8 is a fragmentary sectional view illustrating the sealed joint between the strut and the pod housing.
Figure 9:
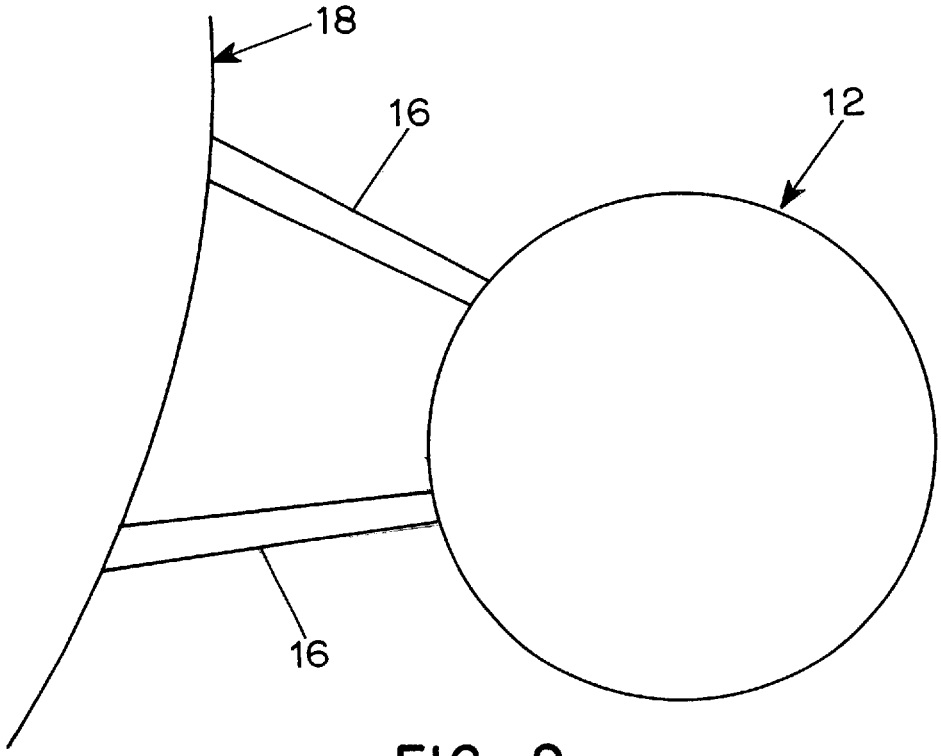
FIG. 9 is a schematic end view looking at a pod arrangement having two support struts in a "V" configuration.

As shown in FIG. 1, the strut 16 by which the propulsion pod 10 is attached to the vessel 18 is joined to the propulsion pod in the region of the stationary blade row 24 and preferably the attachment of the strut to the pod is approximately centered on the plane of the stationary blade row. This arrangement provides structural efficiency, ease of cable routing and uniform cooling of the pod and rim drive motor 40. As best seen in FIG. 7, the strut 16 is affixed to the housing 14 by attachment through a transition 72 to a mounting plate 74 and, as shown in FIG. 8, the joint between those two components is sealed with gaskets 76 adjacent to mounting bolts 78 to prevent intrusion of water into the interior of the strut 16. Consequently, power and control lines 78 extending through the strut 16 from the vessel 18 to the rim drive motor 40 will not be subjected to immersion in water. As shown in FIG. 9, two struts disposed in a "V" configuration may be used to provide increased ship attachment stability and decreased strut chord length.

Figure 5:
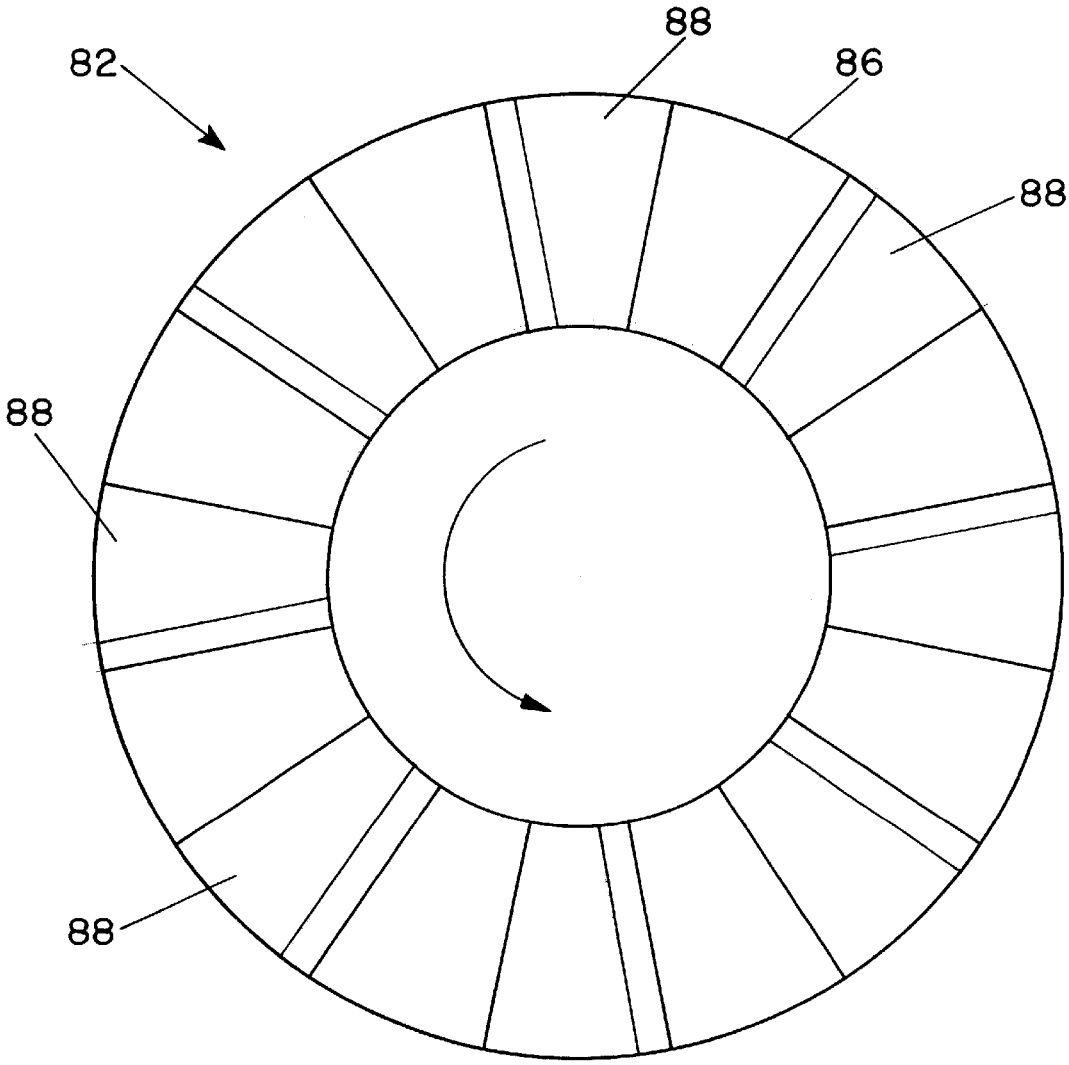
FIG. 5 is a plan view of a thrust ring for transferring thrust from the rotor to the stationary part of the propulsion pod.
Figure 6:
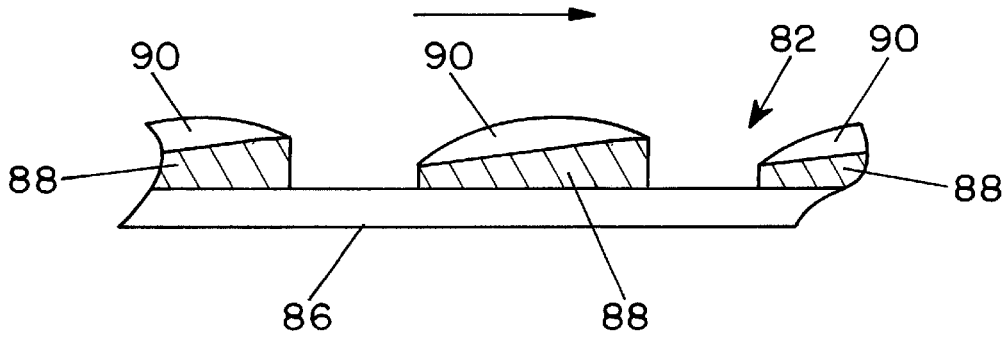
FIG. 6 is a fragmentary sectional view of the thrust ring shown in FIG. 5.

In order to transfer thrust forces from the rotor assembly 20 to the rotor support assembly 22, and ultimately through the support members 24 and the strut 16 to the vessel 18, in an efficient manner a thrust ring 82, shown in FIGS. 5 and 6, is mounted at the forward end of the hub 28 of the rotor assembly facing a thrust plate 84 affixed to the rotor support assembly 22. The thrust ring 82, which rotates with the rotor, includes a backing plate 86 to which a circumferential array of thrust pads 88 is affixed. Each of the thrust pads 88 has a wedge shape in cross-section as seen in FIG. 6 arranged so that, as the rotor assembly rotates, the wedge shape of the thrust pads create a local pressure gradient which enhances formation of a water wedge 90 to lubricate the bearing surfaces and inhibit excessive wear.

Although the invention has been described herein with reference to specific embodiments, many modifications and variations therein will readily occur to those skilled in the art. Accordingly, all such variations and modifications are included within the intended scope of the invention.

We claim:

1. A rim-driven propulsion pod arrangement comprising:

a propulsion pod having a generally cylindrical housing forming a duct with an axial flow path for water from a forward end to an aft end;

an axial rotor support assembly mounted within the housing by a plurality of angularly distributed support members extending between the housing and the support assembly;

a rotor assembly having a hub supported for rotation on the support assembly and an angularly distributed row of rotor blades mounted on the hub and a peripheral rim mounted on the outer ends of the row of rotor blades, the peripheral rim being received within an annular recess in the housing so as to be disposed out of the flow path of water through the duct formed by the housing;

a passage for conveying water from a high pressure region aft of the rotating rotor blade row through a space between the peripheral rim and the recessed portion of the housing and having an outlet at a low pressure region of the duct forwardly of the rotor blade row and arranged at an angle to direct water emerging from the flow path rearwardly toward the rotor blade row;

a rim drive motor comprising a stator in the annular recess and a rotor in the rim of the rotor assembly containing permanent magnets to drive the rotor in response to energization of windings in the stator, the rotor being disposed closer to the forward end of the duct than the support members; and at least one strut connecting the housing to a vessel to be driven by the propulsion pod and connected to the propulsion pod in a plane containing the support members, thereby avoiding obstruction of heat transfer from the stator through the housing to water surrounding the housing.

2. A rim-driven propulsion pod arrangement according to claim 1 wherein the support members comprise vanes arranged for straightening the flow of water emerging from the rotating rotor blade row.

3. A rim-driven propulsion pod arrangement according to claim 1 wherein the outlet from the passage is directed rearwardly at an angle between about 30° and about 60° with respect to the direction of flow of water through the duct.

4. A rim-driven propulsion pod arrangement according to claim 3 wherein the outlet from the passage is directed rearwardly at an angle between about 30° and about 45° with respect to the direction of flow of water through the duct.

5. A rim-driven propulsion pod arrangement according to claim 1 including impact absorbing projections within the space between the rotor and the stator made of a material which is softer than that of the rotor and the stator to prevent excessive excursions of the rotor with respect to the housing and avoid damage to the propulsion pod resulting from impacts.

6. A rim-driven propulsion pod arrangement according to claim 1 including a radial bearing member on the rotor assembly having a surface which is softer than the surface of the support assembly on which it is supported.

7. A rim-driven propulsion pod arrangement according to claim 1 including a thrust bearing arrangement for transmitting thrust from the rotor assembly to the support assembly including wedge-shaped members forming a water wedge between facing surfaces of the rotor assembly and the support assembly during rotation of the rotor assembly.

8. A rim-driven propulsion pod arrangement according to claim 1 wherein the strut contains power lines and is connected to the propulsion pod with sealing gaskets to prevent water from entering the strut.

9. A rim-driven propulsion pod arrangement according to claim 1 wherein the support members comprise a row of vanes for straightening the flow of water emerging from the rotating rotor blade row and wherein the rotating rotor blade row and the row of vanes are designed as a set to minimize induced structural vibration and optimize efficiency and cavitation.

10. A rim-driven propulsion pod arrangement according to claim 9 wherein the axial spacing between the rotating rotor blade row and the stationary vane row is between about 25% and about 100% of the chord length of the blades in the rotating rotor blade row.

11. A rim-driven propulsion pod arrangement according to claim 9 wherein the number of blades in the rotating rotor blade row is from five to fifteen.

12. A rim-driven propulsion pod arrangement according to claim 9 wherein the number of vanes in the row of vanes is from five to fifteen.

13. A rim-driven propulsion pod arrangement according to claim 9 wherein the percentage of the cross-sectional area of the duct covered by the blades in the rotating rotor blade row if viewed in the axial direction is between about 50% and 110%.

14. A rim-driven propulsion pod arrangement according to claim 9 wherein the percentage of the cross-sectional area of the duct covered by the row of vanes if viewed in the axial direction is between about 50% and about 110%.

15. A rim-driven propulsion pod arrangement according to claim 1 wherein the positioning of at least one strut in the plane containing the support members is effective to assure substantially uniform cooling of the motor stator.

16. A rim-driven propulsion pod arrangement according to claim 1 including two struts connecting the housing to the vessel arranged in a V configuration to provide increased ship attachment stability and decreased strut length.

17. A rim-driven propulsion pod arrangement according to claim 1 wherein the stator and rotor assembly are encased in composite resin material.

* * * * *